US006978639B2

(12) United States Patent
Underwood

(10) Patent No.: US 6,978,639 B2
(45) Date of Patent: Dec. 27, 2005

(54) TONGUE JEWELRY CLIP AND METHOD OF WEARING THE SAME

(76) Inventor: Michael Lee Underwood, 815 N. Hayden Rd., #D15, Scottsdale, AZ (US) 85257

( * ) Notice: Subject to any disclaimer, the term of this patent is extended or adjusted under 35 U.S.C. 154(b) by 0 days.

(21) Appl. No.: 10/412,951

(22) Filed: Apr. 15, 2003

(65) Prior Publication Data

US 2004/0206114 A1 Oct. 21, 2004

(51) Int. Cl.[7] ..... A44C 7/00; A44C 15/00
(52) U.S. Cl. ..... 63/13
(58) Field of Search ..... 63/14.1, 14.3, 63/14.4, 14.5, 14.6, 14.7, 14.8, 12, 13

(56) References Cited

U.S. PATENT DOCUMENTS 1,287,067 A * 12/1918 Markham ..... 63/14.7
1,304,986 A * 5/1919 Kassler ..... 63/14.3
2,398,833 A * 4/1946 Kaa ..... 63/14.7
2,611,165 A * 9/1952 Straka ..... 24/72.5
2,710,511 A * 6/1955 Baldwin ..... 63/14.7
2,858,679 A * 11/1958 Moreschi ..... 63/14.7
3,760,604 A * 9/1973 DiStefano ..... 63/12
4,353,225 A * 10/1982 Rogers ..... 63/13
4,783,974 A * 11/1988 Hernandez ..... 63/1.16
4,793,155 A * 12/1988 Law ..... 63/40
5,044,176 A * 9/1991 King ..... 63/12
6,014,870 A * 1/2000 Horner et al. ..... 63/13
6,138,333 A * 10/2000 Hollingworth ..... 24/705
6,138,475 A * 10/2000 Kohl et al. ..... 63/12
6,382,815 B1 5/2002 Klearman et al.
6,419,649 B1 * 7/2002 Klein ..... 601/70
6,557,220 B1 * 5/2003 Hamm, Jr. ..... 24/705
2001/0047664 A1 * 12/2001 Andrews et al. ..... 63/31

FOREIGN PATENT DOCUMENTS

JP 03267001 A * 11/1991 ..... A44C 7/00

* cited by examiner

*Primary Examiner*—Jack W. Lavinder
(74) *Attorney, Agent, or Firm*—Janine R. Novatt; Harry M. Weiss; Weiss, Moy & Harris, P.C.

(57) ABSTRACT

A tongue jewelry clip and method for wearing the clip is provided. The tongue jewelry clip includes a substantially thin, narrow, and rigid strip of metal bent to include at least one U-shaped section for wrapping around at least one edge of the tongue. The U-shaped section may be at one or both ends of the strip or in the middle. One or more tongue ornaments may be removably mounted to a first wall of the clip and a fastening assembly through the second wall of the clip member fastens the clip member onto the tongue. The one or more tongue ornaments may be non-pierced or pierced.

4 Claims, 1 Drawing Sheet

TONGUE JEWELRY CLIP AND METHOD OF WEARING THE SAME

FIELD OF THE INVENTION

This invention relates generally to body jewelry. More specifically, this invention relates to a tongue jewelry clip and the method of wearing the same.

BACKGROUND OF THE INVENTION

Throughout history, people have decorated and altered the appearance of their bodies in many different ways. Body piercing is one of the oldest and most interesting forms of body modification, yet the reasons for piercing the body are as diverse as the cultures they come from. For example, tongue piercing was practiced in the ancient temples of the Aztecs and Mayans. Aztec and Mayan Shamans and High Priests pierced their tongues as part of a ritual to communicate with their gods. Nowadays, both men and women can find tongue piercing sexually arousing, useful for the adult market, as well as empowering as an expression of individuality. For some it is simply a fashion statement. Others use it to gain attention, or for its shock value. Some teens choose piercing as a statement of rebellion against society, parental values, or lifestyle practices, while others are merely exhibiting a personal preference.

To pierce the tongue, a clamp or forceps may be used to pinch the tongue and stretch it out. Tongue piercings are placed in the center of the tongue to minimize the risk of nerve and blood vessel damage. A hollow needle is passed through the tongue midline followed by the insertion of the body jewelry in the hole. The hollow needle is similar to the tip of a syringe, but with jewelry in it. When the needle is threaded out, the jewelry remains. Various kinds of jewelry or pierced tongue ornaments include barbells, captive bead rings, which are rings connected by a ball, and other screw-on ornaments. A barbell is a metal rod with threads on both ends that have balls that screw on either end. Because of the invasive nature of the piercing process, non-toxic metals such as surgical steel, 14K gold, niobium, or titanium are often recommended for the tongue jewelry to avoid infections and allergic reactions. The procedure itself may be painful. In addition, unsterile piercing equipment and needles can spread serious infection, hepatitis, tetanus, or possibly even HIV. There is also a risk of nerve and blood vessel damage. Symptoms following a piercing may include pain, swelling, infection, and increased salivary flow. Healing requires four to six weeks, in the absence of complications. There is typically no anesthesia during the procedure.

Other problems associated with oral piercing include tooth trauma, tongue swelling, interference with chewing, swallowing, and speaking, increase of saliva flow, metal hypersensitivity, foreign debris in the piercing site, allergic reactions, and altered taste buds. Moreover, there may be irritation to the gums and frenulum (the web of tissue which runs lengthwise along the underside of the tongue, usually present in most people to some degree). Over the long term, continued irritation may cause erosion of the gums and possibly bone loss beneath the gums. Tooth trauma including chipped and cracked teeth and enamel erosion are also risks of tongue piercing. Chipped and cracked teeth are subject to accelerated decay and exposure of the nerve (root) which could require endodontistry (root canal). In addition, piercing through the frenulum often leads to scarring, especially if the frenulum is large or extrudes making it necessary to have the frenulum clipped by a dentist or oral surgeon.

Aside from the health and body issues associated with tongue piercing, the stigma associated with tongue and other piercings often causes people to shy away from such permanent piercings. For example, there may be situations (e.g. job interviews) where piercings need to be hidden and the wearer tongue jewelry free. For many people otherwise interested in tongue piercing, the pain, risks, and/or stigma associated with tongue piercing are too significant and too permanent.

Accordingly, there has been a need for a novel tongue jewelry clip and method that enable the wearing of tongue jewelry without necessarily requiring piercing of the tongue. There is a further need for a tongue jewelry clip and method that are substantially noninvasive and painless, without substantially any long-term deleterious effects. There is a still further need for a tongue jewelry clip and method that are easily and readily placed on the tongue and removed easily by the wearer. There is an additional need for a tongue jewelry clip and method that are substantially comfortable and safe in the mouth. There is another need for a tongue jewelry clip and method that permit thorough cleaning to allow for placement in the mouth. The present invention fulfills these needs and provides other related advantages.

SUMMARY OF THE INVENTION

In accordance with this invention, it is an object of this invention to provide a tongue jewelry clip and method of wearing the same that enable a person to wear tongue jewelry without necessarily piercing the tongue thereby avoiding the pain, risks, and permanency commonly associated therewith.

It is another object of this invention to provide a tongue jewelry clip and method that enable the tongue jewelry clip to be quickly and easily removable as well as easily fastened onto the tongue when its use is desired.

It is another object of this invention to provide a tongue jewelry clip and method that enables the clip to move substantially as one with the tongue to be substantially comfortable and safe in the mouth and permits drinking of beverages.

The tongue jewelry clip comprises, generally, an elongated clip member having at least one U-shaped section for wrapping around at least one edge of the tongue and means for fastening the clip member onto the tongue. The clip member may also include at least one tongue ornament that may be mounted onto the clip member for ornamentation.

The elongated clip member comprises a substantially thin, narrow and rigid strip of metal, preferably surgical stainless steel, bent to form the at least one U-shaped section to securely wrap around at least one edge of the tongue. An inner surface of the clip member is proximate the tongue. An outer surface of the clip member is generally visible when the clip member is fastened onto the tongue. The clip member includes substantially parallel first and second walls extending from opposite sides of the at least one U-shaped section. The clip member may define a generally J, U, C, or O-shaped clip member depending on the position of the at least one U-shaped section.

The at least one tongue ornament may be mounted to the first wall of the clip member. The first wall may include one or more longitudinally spaced apertures to receive a first end of a tongue ornament mounting post. To substantially prevent the first end of the tongue ornament mounting posts from impinging on the tongue, the apertures may be closed at the inner surface of the clip member or the tongue ornament mounting posts may be inserted until they are substantially flush with the inner surface of the first wall.

A second end of the tongue ornament mounting post protrudes upwardly from the outer surface of the first wall of the clip member. The second end of the tongue ornament mounting posts may be threaded to permit removable mounting of a tongue ornament to allow the wearer to change the particular tongue ornament when desired. The at least one tongue ornament may also be permanently affixed to the outer surface of the clip member with or without use of the tongue ornament mounting posts.

The second wall of the clip member includes a passage for receiving the fastening means. The passage may be bored or threaded. The fastening means comprises at least one fastening assembly. The at least one fastening assembly comprises a pedestal including a pressure plate and a stem extending downwardly therefrom. The stem may be surrounded by a spring and threaded at its lower end. Alternatively, the stem of the pedestal may be threaded along substantially its entire length. A ball may be threaded on the lower end of the stem after the stem is inserted through the passage in the second wall. The spring-loaded stem is slip fitted through a bored passage and the threaded stem through a threaded passage. The pressure plate is inboard of the clip member.

Alternatively, the fastening assembly comprises at least one fixed screw with a catch head flush mounted in the second wall of the clip member with the stem of the screw protruding inboard of the second wall with the opposite end flush mounted in the pressure plate. The stem of the fixed screw is surrounded by a spring.

In the method of the invention, the wearer either pulls down or turns the ball to enlarge the gap between an upper surface of the pressure plate and the inner surface of the first wall. The tongue is positioned in the gap. The elongated clip member is slipped over at least one edge of the tongue so that the least one U-shaped section hooks around at least one edge of the tongue. The tongue jewelry clip may be worn down the center of the tongue along its longitudinal axis or along the tongue's horizontal axis. Once the U-shaped section(s) of the clip member are slipped over the edge(s) of the tongue in the desired location, the clip member is secured on the tongue by narrowing the gap by either releasing the ball to bias the spring upwardly against the pressure plate or by turning the ball in the opposite direction to rotate the stem through the threaded passage and move the upper surface of the pressure plate against the underside of the tongue.

The tongue jewelry clip may also be used with conventional pierced tongue ornaments, such as a barbell or the like. When used in this manner, at least one of the apertures in the first wall is vertically aligned with the passage in the second wall for through passage of a post of the pierced tongue ornament.

The fastening assembly for use with conventional pierced tongue ornaments includes a pressure plate with an opening substantially in the center thereof to permit the post from the pierced tongue ornament to pass through it and into the passage in the second wall of the clip member where it exits on the outboard side of the clip member. The post is surrounded by a spring at the inner surface of the clip member. Once the lower end of the post exits on the outboard side of the clip member, a fastener such as the threaded ball from a conventional pierced tongue ornament may be threaded on the lower end of the post.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
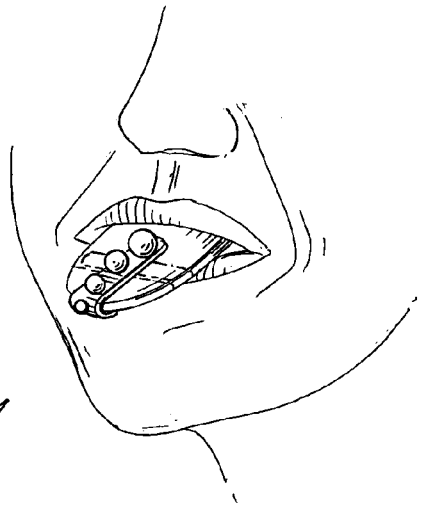
FIG. 1 is a perspective view of a tongue jewelry clip wrapped around a front edge of the tongue embodying the novel features of the invention, and also showing alternative placement in phantom lines around a side edge of the tongue.

As shown in the drawings for purposes of illustration, the present invention is concerned with a tongue jewelry clip, generally designated in the accompanying drawings by the reference number 10. The method for wearing the clip is also provided. The tongue jewelry clip comprises, generally, an elongated clip member 12 having at least one U-shaped section 14 for wrapping around at least one edge of the tongue 16 and at least one fastening assembly 18*a*–18*d* for fastening the clip member onto the tongue. The clip member may also include at least one tongue ornament 20 that may be mounted onto the clip member 12 for ornamentation.

In accordance with the present invention, and as illustrated with respect to a preferred embodiment in FIGS. 1–9, the tongue jewelry clip 10 enables a person to wear tongue jewelry without necessarily piercing the tongue thereby avoiding the pain, risks, and permanency commonly associated therewith. The tongue jewelry clip is quickly and easily removable as well as easily fastened onto the tongue when its use is desired. The tongue jewelry clip substantially moves as one with the tongue so it is substantially comfortable and safe in the mouth and permits drinking of beverages.

As illustrated in FIG. 1, the elongated clip member 12 comprises a substantially thin, narrow and rigid strip of metal, preferably surgical stainless steel, bent to form the at least one U-shaped section 14 adapted to securely wrap around at least one edge of the tongue 16. An inner surface 22 of the clip member 12 is proximate the tongue 16. An outer surface 24 of the clip member 12 is generally visible when the clip member 12 is fastened onto the tongue 16. The at least one U-shaped section 14 may be angular or curved.

The clip member 12 includes substantially parallel first and second walls 26 and 28 extending from opposite sides of the at least one U-shaped section 14. The clip member 12 may include the U-shaped section 14 at one end to define a generally J-shaped elongated clip member. Although the elongated J-shaped clip member shown in FIGS. 2–3 and 7 and 9 has a first wall 26 longer than the second wall 28, it is to be appreciated that the first wall 26 may be shorter than the second wall 28.

As another alternative, the clip member 12 may include the U-shaped section 14 in substantially the middle of the strip to define a generally U-shaped elongated clip member (not shown) with the first and second walls 26 and 28 of the U-shaped elongated clip member substantially the same length. Both the J and U-shaped elongated clip members may wrap around the front edge (i.e. the tip) or a side edge of the tongue 16 as hereinafter described. Alternatively, the clip member 12 may include the U-shaped section 14 at both ends of the strip with one or both of the first and second walls 26 and 28 joined respectively with the first and second walls 26 and 28 from the opposite U-shaped section to define a generally elongated C-shaped clip member (not shown) or an elongated O-shaped clip member (not shown). Both the elongated C-shaped and O-shaped clip members are generally sized so that the U-shaped sections may wrap around opposite side edges of the tongue 16.

Although the clip member is described as preferably made from surgical stainless steel, other rigid materials suitable for oral placement may be used. The material must be suitable for thorough cleaning because of its use in the mouth. Such other suitable materials include, but are not limited to, a rigid plastic, composites, and hardened ceramics. Materials must be selected taking oral placement of the clip member into consideration. For example, a brittle material may not be desirable because of the danger of breakage inside the mouth. The clip member 12 may itself be made decorative, for example, by etchings, polishing, etc. and/or by incorporation of decorative branches or offshoots (not shown) from one or both of the first and second walls 26 and 28 of the clip member.

Figure 3:
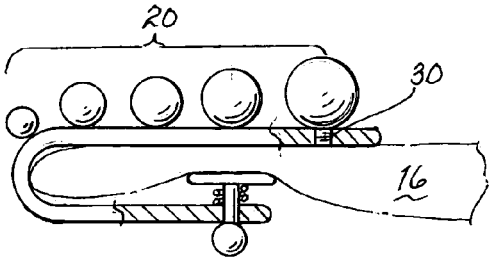
FIG. 3 is a horizontal cross-sectional view of the tongue jewelry clip shown in FIG. 1.
Figure 6:
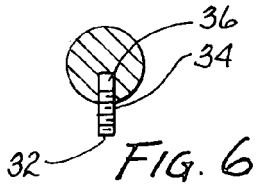
FIG. 6 is a cross-sectional view of a non-pierced tongue ornament mounted on one end of a threaded post taken generally on the line 6—6 of FIG. 2.

The at least one tongue ornament 20 may be mounted to the first wall 26 of the clip member 12. The first wall 26 may include one or more longitudinally spaced apertures 30 as shown in FIG. 3 to receive a first end 32 of a tongue ornament mounting post 34. A second end 36 of the tongue ornament mounting post 34 protrudes upwardly from the outer surface 24 of the first wall 26 of the clip member 12. The at least one tongue ornament 20 may be removably mounted on the second end 36 of the tongue ornament mounting post 34 as hereinafter described and shown in FIG. 6 or the at least one tongue ornament 20 may be integral with the tongue ornament mounting post 34. The tongue ornament mounting posts 34 may be fixed in the apertures during manufacture of the clip member or insertable thereafter. The tongue ornament mounting posts may be press fit into the apertures or they may be threaded at the first end for insertion into threaded apertures. To substantially prevent the first end 32 of the tongue ornament mounting posts 34 from impinging on the tongue 16, the apertures 30 may be closed at the inner surface 22 of the clip member 12 or the tongue ornament mounting posts 34 may be inserted until they are substantially flush with the inner surface 22 of the first wall 26.

Figure 2:
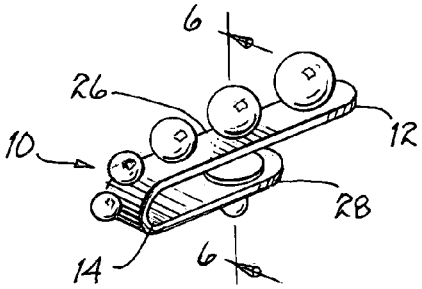
FIG. 2 is an enlarged perspective view of the tongue jewelry clip shown in FIG. 1.

The second end 36 of the tongue ornament mounting posts 34 may be threaded to permit removable mounting of a threaded tongue ornament 20 to allow the wearer to change the particular tongue ornament when desired. The tongue ornaments useful in the present invention include, but are not limited to, balls that replicate the visible end used with the pierced barbell as shown in FIGS. 1–3. As with the pierced barbells, the balls useful as tongue ornaments in this invention may be metal or other material, solid, decorated, glow in the dark, happy faces or other designs, faux marble, French tickler or the like, limited only by the imagination. The size of the tongue ornaments used on one tongue jewelry clip may vary as shown in FIG. 3. It is to be understood that any variety of tongue ornament or no tongue ornament at all may be used within the confines of the invention.

Although a removable tongue ornament has been described within the confines of this invention, it is to be appreciated that the at least one tongue ornament may be permanently affixed to the outer surface 24 of the clip member 12 at selected locations, typically on the first wall 26. The tongue ornament mounting posts 34 may not be used with a permanently affixed tongue ornament. Similarly, although a non-pierced tongue ornament has been described, it may also be appreciated that a pierced tongue ornament may be used as hereinafter described.

The second wall 28 of the clip member 12 includes a passage (not shown) for receiving the at least one fastening assembly 18*a* and 18*b*. The passage may be bored or threaded. The fastening assemblies of the first and second embodiments 18*a* and 18*b* are shown respectively in FIGS. 4 and 5. The fastening assemblies 18*a* and 18*b* comprise a pedestal 38*a* and 38*b* including a pressure plate 40*a* and 40*b* and a stem 42*a* and 42*b* extending downwardly therefrom. Although the pressure plate 40*a* and 40*b* and stem 42*a* and 42*b* are shown as one piece, it is to be understood that the pressure plate and stem may be separate pieces. The pressure plate 40*a* and 40*b* may be circular as shown respectively in FIGS. 4 and 5 or any suitable shape with enough surface area to support the underside of the tongue 16. A preferred thickness for the pressure plate 40*a* and 40*b* may be about 1/16 inches thick.

Figures 4, 5:
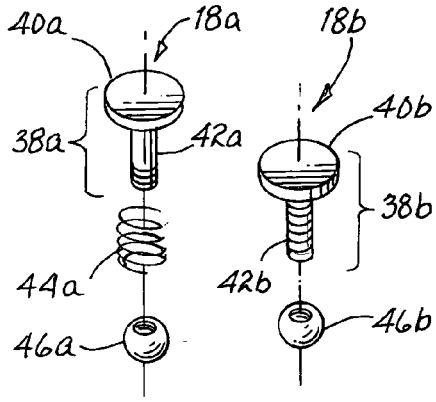
FIG. 4 is an assembly view of a fastening assembly of a first embodiment.
FIG. 5 is an assembly view of a fastening assembly of the second embodiment.

In the first embodiment as shown in FIG. 4, the stem 42*a* is surrounded by a spring 44*a* and is threaded at its lower end for engaging with a threaded fastener, such as the threaded ball 46*a* shown in FIG. 4. In the second embodiment as shown in FIG. 5, the stem 42*b* of the pedestal 38*b* may be threaded along substantially its entire length with the lower end also engaging the threaded ball 46*b* as shown in FIG. 5. The ball 46*a* and 46*b* is intended to provide a rounded finish to the lower end of the stem 42*a* and 42*b* to substantially prevent the lower end of the stem 42*a* and 42*b* from impinging into the bottom of the mouth and provide greater wearing comfort. The ball 46*a* and 46*b* also provides a greater surface area to hold when removing and applying the tongue jewelry clip 10 as hereinafter described.

FIG. 3 shows the fastening assembly 18*a* mounted through the second wall 28 of the clip member 12. The lower portion of the stem 42*a* is slip fitted through the bore (not shown) and retained there by the threaded ball 46*a* outboard of the second wall 28. The pressure plate 40*a* and spring 44*a* are inboard of the clip member 12.

The fastening assembly 18*b* is mounted through the second wall 28 of the clip member 12 in a substantially similar manner, except that the stem 42*b* is threaded through the passage (not shown). The ball 46*b* is threaded on the lower end of the stem 42*b*. The pressure plate 40*b* is inboard of the clip member 12 and the ball 46*b* is outboard of the clip member.

Figure 7:
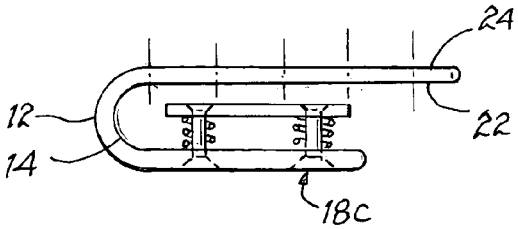
FIG. 7 is a side view of an tongue jewelry clip showing the use of two fastening assemblies of the third embodiment.
Figure 8:
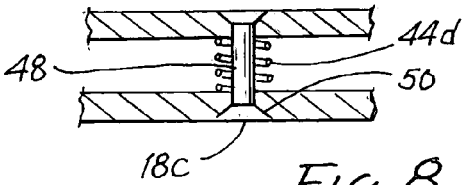
FIG. 8 is an enlarged horizontal fragmented sectional view of the tongue jewelry clip of FIG. 7.

In the third embodiment as shown in FIGS. 7 and 8, the fastening assembly 18*c* comprises at least one fixed screw 48 with a catch head 50 flush mounted in the second wall 28 of the clip member 12 with the screw 48 protruding inboard of the second wall 28 with the opposite end flush mounted in the pressure plate 40*c*. The screw 48 is surrounded by a spring 44*c*. FIG. 7 shows the use of two of these fastening assemblies 18*c* with a clip member.

To use and remove the tongue jewelry clip 10 used with a non-pierced tongue ornament, the wearer either pulls down or turns the ball 46*a* and 46*b* to enlarge the gap between an upper surface of the pressure plate 40*a* and 40*b* and the inner surface 22 of the first wall 26. As shown in FIG. 3, the tongue 16 is positioned in the gap. The elongated clip member 12 is slipped over at least one edge of the tongue so that the least one U-shaped section 14 hooks around at least one edge of the tongue. As shown in FIG. 1, the tongue jewelry clip in the J or U-shaped configuration may be worn down the center of the tongue along its longitudinal axis with the at least one U-shaped section wrapping around the front edge (i.e. the tip) of the tongue with the first and second walls extending along the longitudinal axis of the tongue. The first wall may overlie the dorsal or upper surface of the tongue while the second wall may run down the center of the ventral or underside of the tongue. As shown in phantom lines in FIG. 1, the tongue jewelry clip may also be worn along the tongue's horizontal axis with the at least one U-shaped section 14 wrapping around a side edge of the tongue. The C-shaped or O-shaped clip members may also be used in this manner with the at least one U-shaped section 14 wrapping around both side edges of the tongue. Once the U-shaped section(s) of the clip member are slipped over the edge(s) of the tongue in the desired location, the clip member 12 is secured on the tongue by narrowing the gap by either releasing the ball 46*a* to bias the spring upwardly against the pressure plate or by turning the ball 46*b* in the opposite direction to rotate the stem 42*b* through the threaded passage (not shown) and move the upper surface of the pressure plate 40*a* and 40*b* against the underside of the tongue. The tongue jewelry clip 10 is respectively pulled in and out of the mouth with substantially one movement. The fastening assemblies are substantially hidden from view under the tongue.

The fastening assembly 18*c* may be used to similarly fasten the clip member 12 onto the tongue 16 by urging the tongue into the gap between the upper surface of the pressure plate 40*c* and the inner surface of the first wall 26 with the spring 44*c* urging the pressure plate 40*c* against the underside of the tongue.

Figure 9:
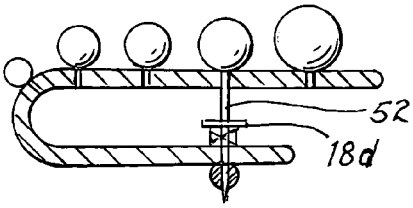
FIG. 9 is an enlarged horizontal sectional view of a tongue jewelry clip used with a pierced tongue ornament.

It is to be appreciated that while the tongue jewelry clip 10 may be used to permit the wearing of tongue jewelry without piercing of the tongue, the clip may also be used with conventional pierced tongue ornaments, such as a barbell or the like. When used in this manner, at least one of the apertures 30 in the first wall 26 is vertically aligned with the passage (not shown) in the second wall 28 for through passage of a post 52 of the pierced tongue ornament as shown in FIG. 9. To minimize the risks of nerve and blood vessel damage when the pierced tongue ornament is inserted, the vertically aligned aperture and passage should preferably be about one inch from the inner surface (inside radius) of the U-shaped section 14 to place the pierced tongue ornament in about the center of the tongue.

A fourth embodiment of the fastening assembly 18*d* may be used with the conventional pierced tongue ornament to substantially prevent side to side movement of the clip member around the post 52. The fourth embodiment includes a pressure plate 40*d* with an opening (not shown) substantially in the center thereof to permit the post 52 from the pierced tongue ornament to pass through it and into the passage (not shown) in the second wall of the clip member where it exits on the outboard side of the clip member. The post 52 is surrounded by a spring 44*d* at the inner surface of the clip member. Once the lower end of the post 52 exits on the outboard side of the clip member, a fastener such as the threaded ball from a conventional pierced barbell as shown in FIG. 9 may be threaded on the lower end of the post.

From the foregoing, it is to be appreciated that the device 10 and method of the present invention enable a person to wear tongue jewelry comfortably and safely without necessarily piercing the tongue. The present invention enables that person to substantially avoid the pain, risks, and permanency associated with tongue piercing.

Although a particular embodiment of the invention has been described in detail for purposes of illustration, various modifications may be made without departing from the spirit and scope of the invention. Accordingly, the invention is not to be limited, except as by the appended claims.

I claim:

1. A tongue jewelry clip comprising:

an elongated clip member dimensioned for a tongue and having at least one U-shaped section for wrapping around at least one edge of the tongue and a first wall and a second wall extending from opposite sides of the at least one U-shaped section;

at least one fastening assembly for securing the elongated clip member onto the tongue so that the first wall adapted to extends along one of the axes of the upper surface of the tongue; and at least one tongue ornament mounted on the first wall of the elongated clip member adapted to project outwardly from the upper surface of the tongue, the at least one tongue ornament comprising at least one pierced tongue ornament having a rearwardly projecting post wherein the elongated clip member includes at least one aperture in the first wall and at least one passage in the second wall that are vertically aligned for through passage of the rearwardly projecting post of the at least one pierced tongue ornament, the rearwardly projecting post received through a pressure plate and surrounded by a spring under the pressure plate and retained on the opposite side of the second wall by a fastener.

2. A method of wearing a tongue jewelry clip, comprising the steps of:

providing a tongue jewelry clip dimensioned for a tongue having at least one U-shaped section for wrapping around at least one edge of the tongue and at least one fastening assembly to secure the tongue jewelry clip onto the tongue;

mounting at least one tongue ornament to the tongue jewelry clip;

moving the at least one fastening assembly downwardly to enlarge the gap between a pressure plate of the at least one fastening assembly and an inboard surface of the tongue jewelry clip;

inserting the tongue into the gap until the at least one U-shaped section wraps around at least one edge of the tongue and the at least one tongue ornament protrudes outwardly from the tongue jewelry clip along the upper surface of the tongue; and moving the at least one fastening assembly upwardly to narrow the gap and force the pressure plate against the underside of the tongue.

3. The method of claim 2, wherein the at least one fastening assembly includes the pressure plate and a stem extending downwardly therefrom and threaded on at least a lower end for insertion through at least one passage in a second wall of the tongue jewelry clip and retained by a fastener on the lower end of the stem, the fastening assembly moved downwardly and upwardly by moving the fastener.

4. The method of claim 3, wherein the fastener is pulled down to enlarge the gap and released to narrow the gap.

* * * * *